US010830045B2

(12) United States Patent
Perisse et al.

(10) Patent No.: US 10,830,045 B2
(45) Date of Patent: Nov. 10, 2020

(54) SCROLL COMPRESSOR HAVING A BASEPLATE INCLUDING FIRST AND SECOND CYLINDRICAL RIM PORTIONS

(71) Applicant: Danfoss Commercial Compressors, Trevoux (FR)

(72) Inventors: Philippe Perisse, Montmerle sur Saone (FR); Patrice Oliveau, Albigny sur Saone (FR)

(73) Assignee: Danfoss Commercial Compressors, Trevoux (FR)

( * ) Notice: Subject to any disclaimer, the term of this patent is extended or adjusted under 35 U.S.C. 154(b) by 220 days.

(21) Appl. No.: 15/955,794

(22) Filed: Apr. 18, 2018

(65) Prior Publication Data

US 2018/0320519 A1 Nov. 8, 2018

(30) Foreign Application Priority Data

May 3, 2017 (FR) ..... 17 53866

(51) Int. Cl.
*F01C 1/02* (2006.01)
*F04C 23/00* (2006.01)
(Continued)

(52) U.S. Cl.
CPC ..... *F01C 1/0253* (2013.01); *F01C 21/007* (2013.01); *F01C 21/02* (2013.01);
(Continued)

(58) Field of Classification Search
CPC ..... F01C 1/0253; F01C 21/007; F01C 21/02; F01C 21/10; F04B 39/0044; F04B 35/04;
(Continued)

(56) References Cited

U.S. PATENT DOCUMENTS 8,152,500 B2 4/2012 Beagle et al.
2008/0166252 A1 7/2008 Stover
(Continued)

FOREIGN PATENT DOCUMENTS

CN 101965439 A 2/2011
CN 203081751 A 7/2013
(Continued)

*Primary Examiner* — Patrick Hamo
*Assistant Examiner* — Paul W Thiede
(74) *Attorney, Agent, or Firm* — McCormick, Paulding & Huber PLLC

(57) ABSTRACT

The scroll compressor (2) comprises a hermetic enclosure (3) comprising a midshell (4), an upper cap (5) and a baseplate (6), the baseplate (6) comprising a mounting base (32) having a plate shape and including a central opening (33), and a central cap (28) arranged within the central opening (33), the central cap (28) comprising a concave portion (29) and a first cylindrical rim portion (30) extending upwardly and having an outer diameter substantially corresponding to an inner diameter of the midshell (4); a compression unit (11) configured to compress refrigerant; and an electric motor (21) configured to drive the compression unit (11) via a drive shaft (19). The mounting base (32) comprises a second cylindrical rim portion (34) extending upwardly and surrounding the central opening (33), wherein an inner diameter of the second cylindrical rim portion (34) substantially corresponds to the inner diameter of the midshell (4) and to an outer diameter of the first cylindrical rim portion (30).

20 Claims, 3 Drawing Sheets

(51) Int. Cl.

| | |
|---|---|
| ***F01C 21/10*** | (2006.01) |
| ***F01C 21/00*** | (2006.01) |
| ***F04C 18/02*** | (2006.01) |
| ***F04B 39/00*** | (2006.01) |
| ***F01C 21/02*** | (2006.01) |

(52) U.S. Cl.
CPC ..... *F01C 21/10* (2013.01); *F04C 18/0253* (2013.01); *F04C 23/001* (2013.01); *F04C 23/008* (2013.01); *F04B 39/0044* (2013.01); *F04C 2230/231* (2013.01); *F04C 2230/60* (2013.01); *F04C 2230/603* (2013.01); *F04C 2230/70* (2013.01); *F04C 2240/30* (2013.01); *F04C 2240/70* (2013.01)

(58) Field of Classification Search
CPC ..... F04C 18/0253; F04C 2230/231; F04C 2230/60; F04C 2230/603; F04C 2230/70; F04C 2240/30; F04C 2240/70; F04C 23/001; F04C 23/008; F04C 18/0215; F04C 2240/56; F04C 2240/605; F04C 27/001; F04C 27/005; F04C 29/0071; F04C 15/0061; F04C 17/06; F16C 19/44
USPC ... 418/55.1, 55.2, 55.3, 55.4, 55.5, 15, 55.6, 418/182; 428/403; 384/29, 95, 129, 255, 384/276, 290, 296, 447; 417/410.1
See application file for complete search history.

(56) References Cited

U.S. PATENT DOCUMENTS

| | | | | |
|---|---|---|---|---|
| 2013/0251550 | A1* | 9/2013 | Cullen, Jr. ..... | F04B 39/0044 417/321 |
| 2014/0154110 | A1* | 6/2014 | Zhou ..... | F01C 21/10 417/363 |
| 2015/0247500 | A1* | 9/2015 | Duppert ..... | F04C 29/005 418/55.3 |
| 2016/0032943 | A1* | 2/2016 | Eddie ..... | F04D 29/601 220/652 |
| 2018/0021850 | A1* | 1/2018 | Ruxanda ..... | F16C 17/26 428/403 |

FOREIGN PATENT DOCUMENTS

| | | |
|---|---|---|
| CN | 206050550 U | 3/2017 |
| CN | 107120270 A | 9/2017 |

* cited by examiner

SCROLL COMPRESSOR HAVING A BASEPLATE INCLUDING FIRST AND SECOND CYLINDRICAL RIM PORTIONS

CROSS-REFERENCE TO RELATED APPLICATION

This application claims foreign priority benefits under U.S.C. § 119 to French Patent Application No. 1753866 filed on May 3, 2017, the content of which is hereby incorporated by reference in its entirety.

TECHNICAL FIELD

The present invention relates to a scroll compressor, and in particular to a scroll refrigeration compressor.

BACKGROUND

U.S. Pat. No. 8,152,500 discloses a scroll compressor comprising:

- a hermetic enclosure comprising a midshell, an upper cap and a baseplate, the baseplate comprising:
  - a mounting base having a plate shape and including a central opening, and
  - a central cap arranged within the central opening, the central cap comprising a concave portion and a first cylindrical rim portion extending upwardly and having an outer diameter substantially corresponding to an inner diameter of the midshell,
- a compression unit configured to compress refrigerant, and
- an electric motor configured to drive the compression unit via a drive shaft.

The mounting base of the above-mentioned scroll compressor is secured to the central cap at a position radially inside the inner diameter of the midshell, and via an annular welding seam.

Such a configuration of the baseplate leads to vibration and noise problems, especially in manifolded systems, where at least two scroll compressors are mounted together on a common rail system. Particularly, in a manifolded system, the scroll compressors may be subjected to a rocking movement due to the small contact surface between the central cap and the mounting base.

SUMMARY

It is an object of the present invention to provide an improved scroll compressor which can overcome the drawbacks encountered in conventional scroll compressors.

Another object of the present invention is to provide a scroll compressor which substantially reduces vibration and noise problems.

According to the invention such a scroll compressor comprises:

- a hermetic enclosure comprising a midshell, an upper cap and a baseplate, the baseplate comprising:
  - a mounting base having a plate shape and including a central opening, and
  - a central cap arranged within the central opening, the central cap comprising a concave portion and a first cylindrical rim portion extending upwardly and having an outer diameter substantially corresponding to an inner diameter of the midshell,
- a compression unit configured to compress refrigerant, and

- an electric motor configured to drive the compression unit via a drive shaft, characterized in that the mounting base comprises a second cylindrical rim portion extending upwardly and surrounding the central opening, wherein an inner diameter of the second cylindrical rim portion substantially corresponds to the inner diameter of the midshell and to an outer diameter of the first cylindrical rim portion.

Due to such a configuration of the first and second cylindrical rim portions, the welding of the mounting base and the central cap is easier to control and the manufacturing of the scroll compressor is hence eased. Further the resulting baseplate allows a more stable mounting of the scroll compressor by increasing the area encircled by the contact line between the mounting base and the central cap and by increasing the inner diameter of the central opening, and reduces the risk of rocking movements of the scroll compressor. At the same time, the natural frequency of the entire scroll compressor equipped with the baseplate is shifted to a higher level, which reduces noise and vibration issues.

The scroll compressor may also include one or more of the following features, taken alone or in combination.

According to an embodiment of the invention, the second cylindrical rim portion surrounds at least a lower part of the first cylindrical rim portion.

According to an embodiment of the invention, the first and second cylindrical rim portions are concentrically arranged.

According to an embodiment of the invention, the first cylindrical rim portion has an axial length exceeding an axial length of the second cylindrical rim portion.

According to an embodiment of the invention, the central cap upwardly protrudes from the mounting base.

According to an embodiment of the invention, the second cylindrical rim portion is engaged to the first cylindrical rim portion.

According to an embodiment of the invention, the second cylindrical rim portion is secured, for example welded, to the central cap, and particularly to the first cylindrical rim portion.

According to an embodiment of the invention, the scroll compressor includes an annular welding seam connecting the first cylindrical rim portion with the second cylindrical rim portion, the diameter of the annular welding seam corresponding substantially to the inner diameter of the midshell.

According to an embodiment of the invention, the baseplate is configured to be mounted on two mounting rails extending substantially parallely to each other.

According to an embodiment of the invention, the central cap, and for example the concave portion of the central cap, is provided with two indentations configured to cooperate with and to at least partially receive the two mounting rails. Due to such a configuration of the central cap, the total height of the scroll compressor can be reduced.

According to an embodiment of the invention, the distance between the two indentations substantially corresponds to the distance between the mounting rails.

According to an embodiment of the invention, each indentation has a shape which is at least partially complementary to the outer shape of the respective mounting rail.

According to an embodiment of the invention, the mounting base has a generally rectangular shape, and for example a square shape, and includes four lateral outer edges and four downwardly bent flanges each extending from and along a respective one of the four lateral outer edges.

According to an embodiment of the invention, a first pair of said four downwardly bent flanges is configured to extend substantially parallely to the two mounting rails and a second pair of said four downwardly bent flanges is configured to extend transversally to the two mounting rails, each downwardly bent flange of the second pair only extending along a central part of the respective lateral outer edge.

According to an embodiment of the invention, the scroll compressor further includes an annular welding joint connecting the midshell with the first cylindrical rim portion of the central cap.

According to an embodiment of the invention, the annular welding joint connects a lower edge of the midshell, the first cylindrical rim portion of the central cap and an upper edge of the second cylindrical rim portion of the mounting base.

According to an embodiment of the invention, the midshell includes at least one bracket secured to an inner surface of the midshell, e.g. by welding, and configured to support a lower bearing member rotatably supporting the drive shaft, an upper axial end face of the first cylindrical rim portion abutting against the at least one bracket. Such a configuration of the central cap allows mastering the vertical position of the baseplate in the midshell before welding the baseplate to the midshell, and thus eases the manufacturing of the scroll compressor.

According to an embodiment of the invention, the at least one bracket includes a lower axial end face on which abuts the upper axial end face of the first cylindrical rim portion.

According to an embodiment of the invention, the at least one bracket is L-shaped.

According to an embodiment of the invention, the midshell includes a plurality of brackets secured to the inner surface of the midshell. Advantageously, the brackets are angularly arranged around the drive shaft.

According to an embodiment of the invention, the mounting base further comprises fastening holes configured to accommodate fastening elements, e.g. bolts or screws, to secure the mounting base on the rails.

The midshell may have a constant diameter over its entire length, or may have sections with different diameters.

According to an embodiment of the invention, the midshell is cylindrical and includes an upper end closed by the upper cap and a lower end closed by the baseplate.

According to an embodiment of the invention, the upper cap is welded to the midshell.

According to an embodiment of the invention, the compression unit is arranged within the hermetic enclosure.

According to an embodiment of the invention, the scroll compressor includes a lower bearing member and an upper bearing member configured to rotatably support the drive shaft.

According to an embodiment of the invention, the second cylindrical rim portion extends substantially perpendicularly to the extension plane of the mounting base.

According to an embodiment of the invention, the first and second cylindrical rim portions extends substantially vertically.

These and other advantages will become apparent upon reading the following description in view of the drawing attached hereto representing, as non-limiting example, one embodiment of a scroll compressor according to the invention.

BRIEF DESCRIPTION OF THE DRAWINGS

The following detailed description of one embodiment of the invention is better understood when read in conjunction with the appended drawings being understood, however, that the invention is not limited to the specific embodiment disclosed.

DETAILED DESCRIPTION

Figure 1:
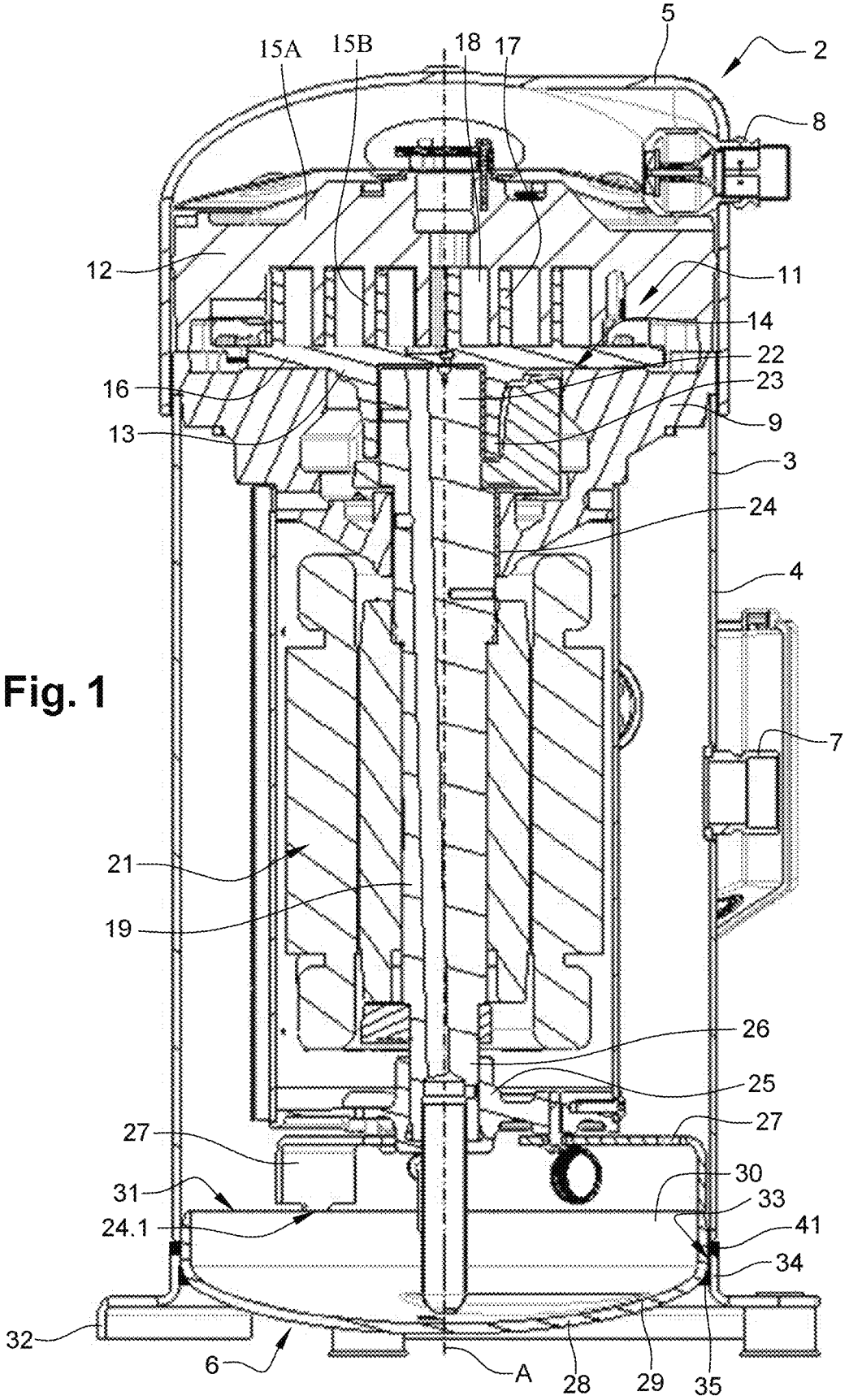
FIG. 1 is a longitudinal section view of a scroll compressor according to the invention.

FIG. 1 shows a scroll compressor 2 comprising a hermetic enclosure 3 comprising a midshell 4, an upper cap 5 and a baseplate 6. As shown on FIG. 1, the midshell 4 is cylindrical and includes an upper end closed by the upper cap 5 and a lower end closed by the baseplate 6. According to the embodiment shown on the figures, the midshell 4 has a constant diameter over its entire length, and the upper cap 5 is welded to the midshell 4.

The scroll compressor 2 further comprises a suction inlet 7 configured to supply the scroll compressor 2 with refrigerant to be compressed, and with a discharge outlet 8 configured to discharge compressed refrigerant. For example, the suction inlet 7 may be provided on the midshell 4 and the discharge outlet 4 may be provided on the upper cap 5.

The scroll compressor 2 also comprises a support frame 9 arranged within the hermetic enclosure 3 and secured to the hermetic enclosure 3, and a compression unit 11 also arranged within the hermetic enclosure 3 and disposed above the support frame 9. The compression unit 11 is configured to compress the refrigerant supplied by the suction inlet 7, and includes a fixed scroll 12, which is fixed in relation to the hermetic enclosure 3, and an orbiting scroll 13 supported by and in slidable contact with a thrust bearing surface 14 provided on the support frame 9.

The fixed scroll 12 includes a fixed scroll base plate 15A having a lower face oriented towards the orbiting scroll 13, and an upper face opposite to the lower face of the fixed scroll base plate 15A. The fixed scroll 12 also includes a fixed spiral wrap 15B protruding from the lower face of the fixed scroll base plate 15A towards the orbiting scroll 13.

The orbiting scroll 13 includes an orbiting scroll base plate 16 having an upper face oriented towards the fixed scroll 12, and a lower face opposite to the upper face of the orbiting scroll base plate 16 and slidably mounted on the thrust bearing surface 14. The orbiting scroll 13 also includes an orbiting spiral wrap 17 protruding from the upper face of the orbiting base plate 16 towards the fixed scroll 12. The orbiting spiral wrap 17 of the orbiting scroll 13 meshes with the fixed spiral wrap 15B of the fixed scroll 12 to form a plurality of compression chambers 18 between them. Each of the compression chambers 18 has a variable volume which decreases from the outside towards the inside, when the orbiting scroll 13 is driven to orbit relative to the fixed scroll 12.

Furthermore the scroll compressor 2 includes a drive shaft 19 configured to drive the orbiting scroll 13 in an orbital movement, and an electric motor 21, which may be a variable-speed electric motor, coupled to the drive shaft 19 and configured to drive in rotation the drive shaft 19 about a rotational axis A. According to the embodiment shown on the figure, the electric motor 21 is disposed below the support frame 9.

The drive shaft 19 comprises, at its upper end portion, an eccentric pin 22 which is eccentrically arranged in relation to the rotational axis A of the drive shaft 19, and which is inserted in a connecting sleeve part 23 provided on the orbiting scroll 13 so as to cause the orbiting scroll 13 to be driven in an orbital movement relative to the fixed scroll 12 when the electric motor 21 is operated.

The scroll compressor 2 further includes an upper bearing member 24 provided on the support frame 9 and configured to cooperate with an outer circumferential wall surface of the eccentric pin 22, and a lower bearing member 25 configured to cooperate with an outer circumferential wall surface of a lower end portion 26 of the drive shaft 19. The lower bearing member 24 and the upper bearing member 26 are particularly configured to rotatably support the drive shaft 19.

Particularly, the midshell 4 includes a plurality of brackets 27 secured to an inner surface of the midshell 4, e.g. by welding, and configured to support the lower bearing member 25. According to the embodiment shown on the figures, the brackets 27 are angularly arranged around the drive shaft, and each bracket 27 is L-shaped.

Figure 2:
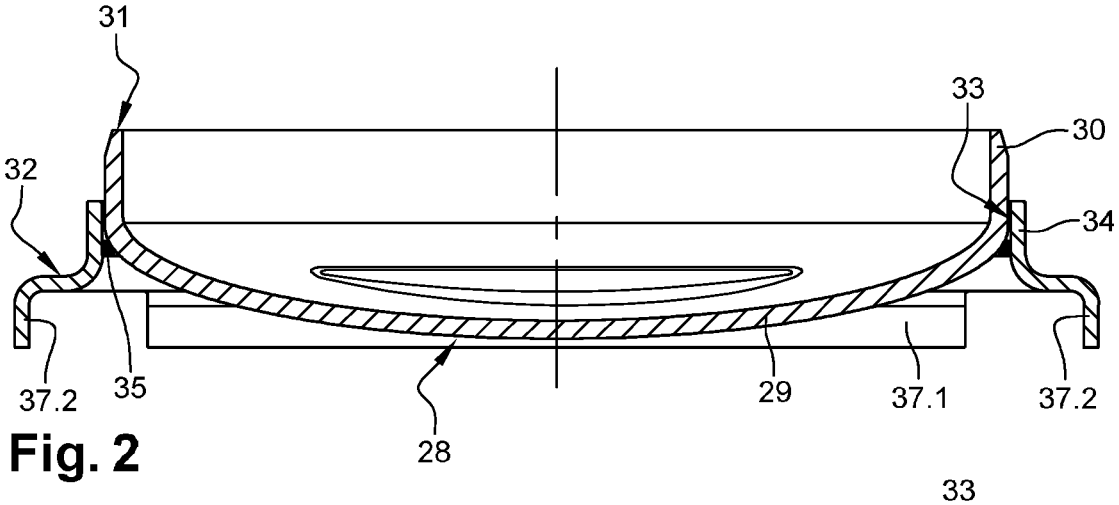
FIGS. 2 and 3 are longitudinal section views of a baseplate of the scroll compressor of FIG. 1.
Figure 3:
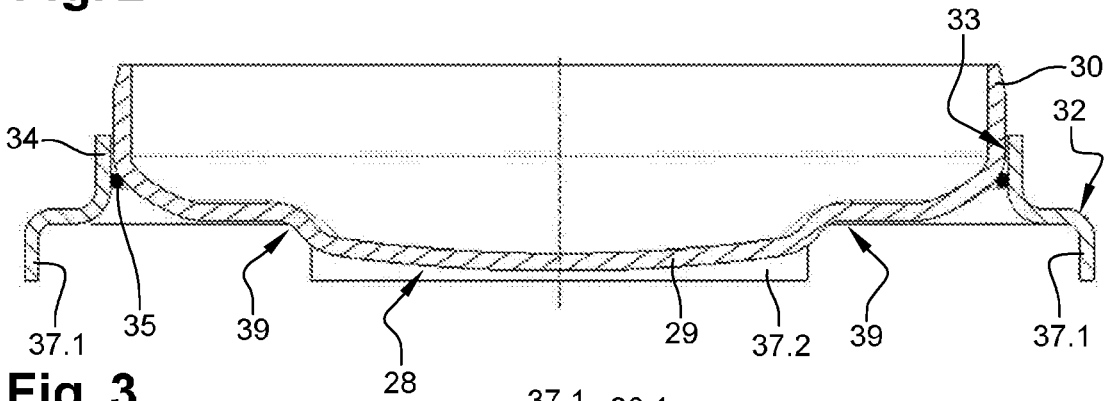

As better shown on FIGS. 2 and 3, the baseplate 6 comprises a central cap 28 including a concave portion 29 and a first cylindrical rim portion 30 extending upwardly from the concave portion 29. The first cylindrical rim portion 30 has an outer diameter substantially corresponding to an inner diameter of the midshell 4. Further, as shown on FIG. 1, each bracket 24 includes a lower axial end face 24.1 on which abuts an upper axial end face 31 of the first cylindrical rim portion 30.

The baseplate 6 further comprises a mounting base 32 having a plate-shaped and including a central opening 33 within which is arranged the central cap 28. The mounting base 32 comprises a second cylindrical rim portion 34 extending upwardly and surrounding the central opening 33. The second cylindrical rim portion 34 has an inner diameter substantially corresponding to the inner diameter of the midshell 4 and to an outer diameter of the first cylindrical rim portion 30, and the first and second cylindrical rim portions 30, 34, are concentrically arranged.

Particularly, the second cylindrical rim portion 34 surrounds a lower part of the first cylindrical rim portion 30 such that an inner surface of the second cylindrical rim portion 34 faces an outer surface of the first cylindrical rim portion 30. Further the first cylindrical rim portion 30 has an axial length exceeding an axial length of the second cylindrical rim portion 34 so that the central cap 28 upwardly protrudes from the mounting base 32.

The second cylindrical rim portion 34 is secured to the first cylindrical rim portion 30. According to the embodiment shown on the figures, the scroll compressor 2 includes an annular welding seam 35 connecting the first cylindrical rim portion 30 with the second cylindrical rim portion 34. Advantageously, the annular welding seam 35 is located at a lower face of the baseplate 6, and the diameter of the annular welding seam 35 corresponds substantially to the inner diameter of the midshell.

Figure 4:
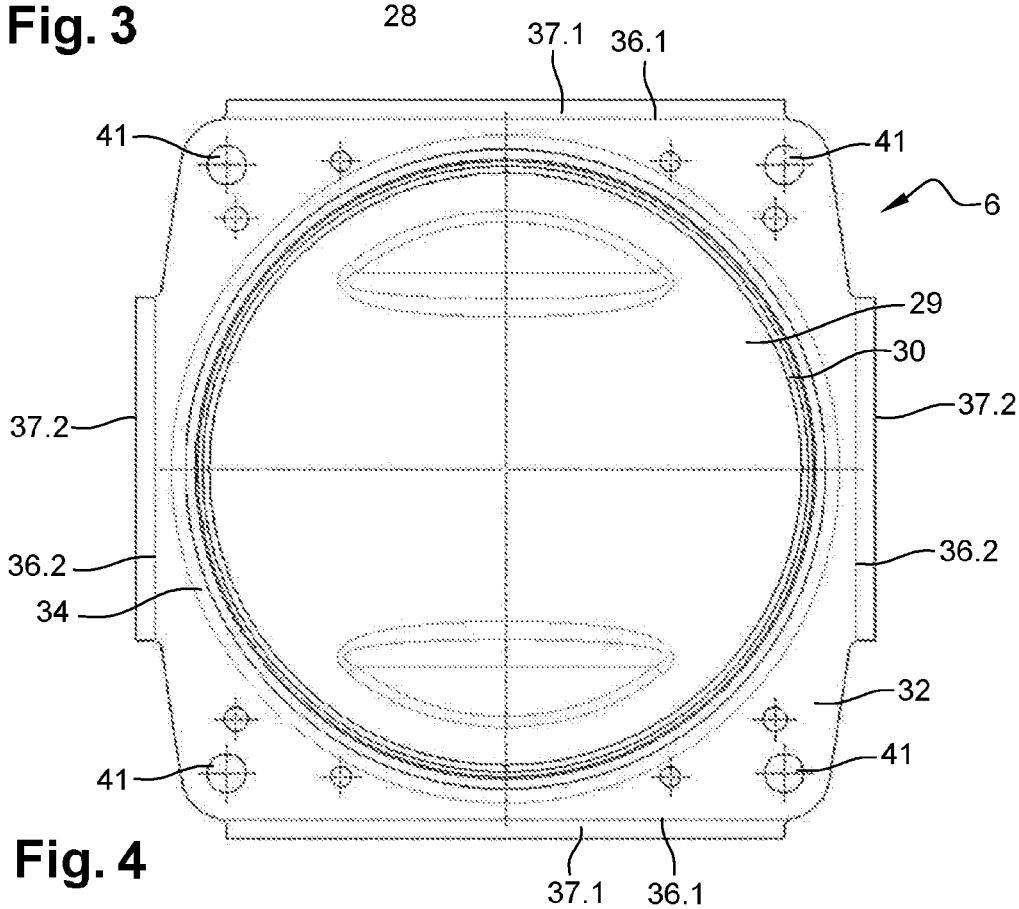
FIG. 4 is a top view of the baseplate of the scroll compressor of FIG. 1.

As better shown on FIG. 4, the mounting base 32 has a generally rectangular shape, and for example a square shape, and includes four lateral outer edges 36.1, 36.2 and four downwardly bent flanges 37.1, 37.2 each extending from and along a respective one of the four lateral outer edges 36.1, 36.2.

Figure 5:
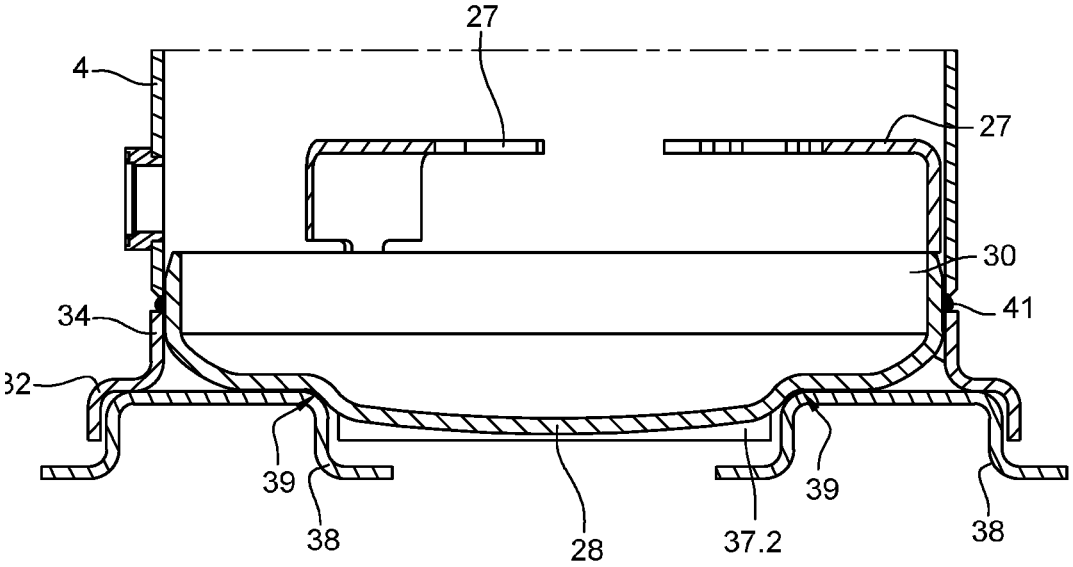
FIG. 5 is a partial longitudinal section view of the scroll compressor of FIG. 1 mounted on two mounting rails.
Figure 6:
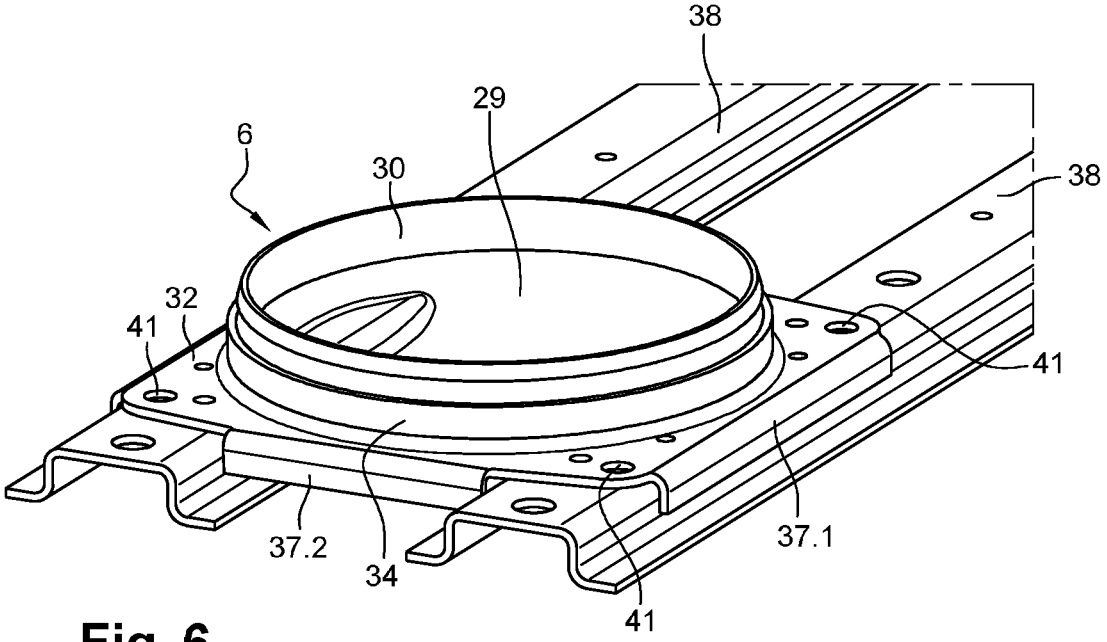
FIG. 6 is a perspective view of the baseplate of FIG. 2 mounted on two mounting rails.

Further, the baseplate 6 is advantageously configured to be mounted on two mounting rails 38 (see FIGS. 5 and 6) extending substantially parallely to each other. The two downwardly bent flanges 37.1 are configured to extend substantially parallely to the two mounting rails 38, and the two downwardly bent flanges 37.2 are configured to extend transversally, and particularly perpendicularly, to the two mounting rails 38. Advantageously, each downwardly bent flange 37.2 only extends along a central part of the respective lateral outer edge 36.2 in order to define passages for the two mounting rails 38.

According to the embodiment shown on the figures, the concave portion 29 of the central cap 28 is provided with two indentations 39 configured to cooperate with the two mounting rails 38. Advantageously, the distance between the two indentations 39 substantially corresponds to the distance between the mounting rails 38, and each indentation 39 has a shape which is at least partially complementary to the outer shape of the respective mounting rail 38. Hereby, the same baseplate may be used for mounting a compressor on rails or on plain surfaces.

The mounting base 32 further comprises fastening holes 41 configured to accommodate fastening elements, e.g. bolts or screws, to secure the mounting base 32 on the rails.

The scroll compressor 2 further includes an annular welding joint 41 (see FIG. 5) connecting the midshell 4 with the first cylindrical rim portion 30 of the central cap 28. Advantageously, the annular welding joint 41 connects a lower edge of the midshell 4, the first cylindrical rim portion 30 of the central cap 28 and an upper edge of the second cylindrical rim portion 34 of the mounting base 32.

Of course, the invention is not restricted to the embodiment described above by way of non-limiting example, but on the contrary it encompasses all embodiments thereof.

The invention claimed is:

1. A scroll compressor comprising:

a hermetic enclosure comprising a midshell, an upper cap and a baseplate, the baseplate comprising:

a mounting base including a central opening; and a central cap arranged within the central opening, the central cap comprising a concave portion and a first cylindrical rim portion extending upwardly and having an outer diameter substantially corresponding to an inner diameter of the midshell;

a compression unit configured to compress refrigerant; and an electric motor configured to drive the compression unit via a drive shaft;

wherein the mounting base comprises a second cylindrical rim portion extending upwardly and surrounding the central opening, wherein an inner diameter of the second cylindrical rim portion substantially corresponds to the inner diameter of the midshell and to an outer diameter of the first cylindrical rim portion;

wherein the outer diameter of the first cylindrical rim portion corresponds to a distance between opposing sides of an outer surface of the central cap;

wherein the inner diameter of the second cylindrical rim portion corresponds to a distance between opposing sides of an inner surface of the mounting base;

wherein the inner surface of the mounting base defines the central opening; and wherein the inner surface of the mounting base and the outer surface of the central cap face each other.

2. The scroll compressor according to claim 1, wherein the second cylindrical rim portion surrounds at least a lower part of the first cylindrical rim portion.

3. The scroll compressor according to claim 2, wherein the first and second cylindrical rim portions are concentrically arranged.

4. The scroll compressor according to claim 2, wherein the first cylindrical rim portion has an axial length exceeding an axial length of the second cylindrical rim portion.

5. The scroll compressor according to claim 2, wherein the central cap upwardly protrudes from the mounting base.

6. The scroll compressor according to claim 1, wherein the first and second cylindrical rim portions are concentrically arranged.

7. The scroll compressor according to claim 6, wherein the first cylindrical rim portion has an axial length exceeding an axial length of the second cylindrical rim portion.

8. The scroll compressor according to claim 6, wherein the central cap upwardly protrudes from the mounting base.

9. The scroll compressor according to claim 1, wherein the first cylindrical rim portion has an axial length exceeding an axial length of the second cylindrical rim portion.

10. The scroll compressor according to claim 9, wherein the central cap upwardly protrudes from the mounting base.

11. The scroll compressor according to claim 1, wherein the central cap upwardly protrudes from the mounting base.

12. The scroll compressor according to claim 1, wherein the second cylindrical rim portion is secured to the central cap.

13. The scroll compressor according to claim 1, wherein further including an annular welding seam connecting the first cylindrical rim portion with the second cylindrical rim portion, a diameter of the annular welding seam corresponding substantially to the inner diameter of the midshell.

14. The scroll compressor according to claim 1, wherein the baseplate is configured to be mounted on two mounting rails extending substantially parallel to each other.

15. The scroll compressor according to claim 14, wherein the central cap is provided with two indentations configured to cooperate with the two mounting rails.

16. The scroll compressor according to claim 14, wherein the mounting base has a generally rectangular shape, and includes four lateral outer edges and four downwardly bent flanges each extending from and along a respective one of the four lateral outer edges, wherein a first pair of said four downwardly bent flanges of the mounting base is configured to extend substantially parallel to the two mounting rails and a second pair of said four downwardly bent flanges is configured to extend transversally to the two mounting rails, each downwardly bent flange of the second pair only extending along a central part of the respective lateral outer edge.

17. The scroll compressor according to claim 1, wherein the mounting base has a generally rectangular shape, and includes four lateral outer edges and four downwardly bent flanges each extending from and along a respective one of the four lateral outer edges.

18. The scroll compressor according to claim 1, further including an annular welding joint connecting the midshell with the first cylindrical rim portion of the central cap.

19. The scroll compressor according to claim 18, wherein the annular welding joint connects a lower edge of the midshell, the first cylindrical rim portion of the central cap and an upper edge of the second cylindrical rim portion of the mounting base.

20. The scroll compressor according to claim 1, wherein the midshell includes at least one bracket secured to an inner surface of the midshell and configured to support a lower bearing member rotatably supporting the drive shaft, an upper axial end face of the first cylindrical rim portion abutting against the at least one bracket.

* * * * *